US011208751B2

(12) United States Patent
Hong et al.

(10) Patent No.: US 11,208,751 B2
(45) Date of Patent: Dec. 28, 2021

(54) WASHING MACHINE

(71) Applicant: LG Electronics Inc., Seoul (KR)

(72) Inventors: Daehoon Hong, Seoul (KR); Sungyun Park, Seoul (KR)

(73) Assignee: LG Electronics Inc., Seoul (KR)

( * ) Notice: Subject to any disclaimer, the term of this patent is extended or adjusted under 35 U.S.C. 154(b) by 22 days.

(21) Appl. No.: 16/768,110

(22) PCT Filed: Nov. 29, 2018

(86) PCT No.: PCT/KR2018/014992
§ 371 (c)(1),
(2) Date: May 29, 2020

(87) PCT Pub. No.: WO2019/107985
PCT Pub. Date: Jun. 6, 2019

(65) Prior Publication Data

US 2020/0318277 A1 Oct. 8, 2020

(30) Foreign Application Priority Data

Nov. 29, 2017 (KR) ..... 10-2017-0162106

(51) Int. Cl.
*D06F 37/30* (2020.01)
*D06F 37/40* (2006.01)

(52) U.S. Cl.
CPC ..... *D06F 37/304* (2013.01); *D06F 37/30* (2013.01); *D06F 37/40* (2013.01)

(58) Field of Classification Search
CPC ..... D06F 37/304
See application file for complete search history.

(56) References Cited

U.S. PATENT DOCUMENTS

2013/0036773 A1 2/2013 Choi et al.

FOREIGN PATENT DOCUMENTS

| | | |
|---|---|---|
| JP | 2002330561 | 11/2002 |
| KR | 1020040071430 | 8/2004 |
| KR | 1020050064926 | 6/2005 |
| KR | 1020130017882 | 2/2013 |
| KR | 1020170052724 | 5/2017 |
| WO | WO2017200329 | 11/2017 |

OTHER PUBLICATIONS

PCT International Search Report in International Application No. PCT/KR2018/014992, dated Mar. 6, 2019, 38 pages (with English translation).

*Primary Examiner* — Jason Y Ko
(74) *Attorney, Agent, or Firm* — Fish & Richardson P.C.

(57) ABSTRACT

A washing machine according to an embodiment of the present disclosure can obtain an effect that increases a drive torque value of a drive motor by appropriately changing a wire diameter of a coil and the number of turns of the coil without changing a reduction ratio of a planetary gear, a size of the drive motor, and a stacking height of a stator core. In detail, a rotational speed ratio between the drive motor and a pulsator, obtained by the planetary gear, is 3.8:1, the stacking height of the stator core is 13.5 mm to 14.5 mm, and the number of turns of the coil is 100 to 140.

9 Claims, 12 Drawing Sheets

WASHING MACHINE

CROSS-REFERENCE TO RELATED APPLICATIONS

This application is a National Stage application under 35 U.S.C. § 371 of International Application No. PCT/KR2018/014992, filed on Nov. 29, 2018, which claims the benefit of Korean Patent Application No. 10-2017-0162106, filed on Nov. 29, 2017. The disclosures of the prior applications are incorporated by reference in their entirety.

TECHNICAL FIELD

The present disclosure relates to a washing machine.

BACKGROUND ART

In general, a washing machine includes an outer tub which stores wash water and a drum which is rotatably provided in the outer tub to store clothes or the like (hereinafter, referred to as "fabrics" or "laundry"), and washes and spin-dries the fabrics according to the rotation of the drum.

Washing machines may be classified into top loading type washing machines in which the center of rotation of a drum is formed vertically such that fabrics can be loaded from the top of the washing machine, and front loading type washing machines in which the center of rotation of a drum is formed horizontally or inclined to be lower toward a lower end such that fabrics can be loaded from the front of the washing machine.

The top loading type washing machines may be largely classified into agitator type washing machines and pulsator type washing machines. The agitator type washing machines perform washing by rotating a washing rod that is vertically erected at the center of a drum, and the pulsator type washing machines perform washing by rotating a disk-shaped pulsator or drum disposed under the drum.

The front loading type washing machine is generally called a drum washing machine. The front loading type washing machine includes a lifter on the inner circumferential surface of the drum and performs washing in such a manner that the lifter lifts and drops fabrics as the drum rotates.

Korean Patent Application Publication No. 10-2004-0071430 (Aug. 12, 2004) (hereinafter, referred to as the prior art) discloses a top loading type full-automatic washing machine.

The washing machine proposed in the prior art is provided with a driver including a drive motor for providing driving force, a spin-drying shaft for rotating an outer tub, a washing shaft for driving a pulsator, and a coupler for selectively driving the spin-drying shaft and the washing shaft.

The coupler transmits rotational force generated by the drive motor to the pulsator during washing and simultaneously transmits rotational force to the pulsator and the outer tub during spin-drying. That is, the washing shaft is always coupled to the drive motor, and the spin-drying shaft is selectively coupled to the drive motor. To this end, the coupler includes a serration that can be engaged with the spin-drying shaft to be vertically movable and can be engaged with a rotor of the drive motor on the outer circumferential surface. Accordingly, when the coupler is lifted, the coupling between the spin-drying shaft and the rotor is released, and when the coupler is lowered, the coupler is engaged with the rotor to transmit the rotational force of the rotor to the spin-drying shaft.

Meanwhile, a planetary gear is mounted on a portion connecting the rotational shaft of the drive motor to the washing shaft, thereby reducing torque of the drive motor for driving the pulsator in a washing mode. That is, there is no inconvenience in driving the pulsator even when a drive motor having a relatively small torque is applied, as compared with a washing machine without a planetary gear. Therefore, the size of the drive motor, specifically, the stacking height of the rotor and the stator core and the height of the rotor are reduced, thereby making the motor slim.

In detail, the stacking height of the stator core is reduced from 27 mm to 14 mm in the condition in which the reduction ratio of the planetary gear is 3.8:1 (one rotation of the pulsator relative to 3.8 rotations of the drive motor), such that the maximum torque of the drive motor reaches about 30.4 Nm.

However, when applied to the top loading type washing machine having a drum with a diameter of 27 inches, which requires a torque of at least 33.5 Nm based on an energy course half load (10.5 kg), the drive motor may not reach the required torque. A driving pattern of an actual drive motor in a washing period may not sufficiently follow a command value, thus deteriorating washing performance.

Therefore, it has been required to change the motor design conditions for increasing the drive torque of the drive motor while keeping the reduction ratio of the planetary gear, the size of the motor, and the stacking height of the stator core as they are.

DISCLOSURE OF THE INVENTION

Technical Problem

The present disclosure has been proposed to improve the above-described problems.

Technical Solution

In order to achieve the above objects, a washing machine includes a cabinet having an opened upper surface and forming an outer appearance, a top cover covering the opened upper surface of the cabinet and having a laundry inlet formed therein, a door coupled to the top cover to open or close the laundry inlet, a base coupled to a lower end of the cabinet to support the cabinet, an outer tub accommodated in the cabinet and filled with wash water, an inner tub which is accommodated in the outer tub and into which laundry is put, a pulsator mounted on a bottom of the inner tub to allow the wash water and the laundry to forcibly flow, and a driver mounted on a bottom of the outer tub to provide rotational force to the pulsator and the inner tub, wherein the driver includes a drive motor including a stator fixed to the bottom of the outer tub and a rotor rotating at an outside of the stator, a shaft portion including a washing shaft that transmits rotational force of the drive motor to the pulsator, and a spin-drying shaft that transmits the rotational force of the drive motor to the inner tub, and a planetary gear disposed at any point of the shaft portion to reduce a rotational speed of the washing shaft and increase torque, wherein the stator includes a plurality of iron plates that are stacked, the plurality of iron plates each including a yoke and a plurality of poles extending radially from an outer edge of the yoke and spaced apart in a circumferential direction, an insulator covering the stator core, and a coil wound around an outer circumferential surface of the pole covered by the insulator, wherein a rotation speed ratio of the drive motor to the pulsator by the planetary gear is 3.8:1, wherein a stacking height of the stator core is 13.5 mm to 14.5 mm, and wherein the number of turns of the coil is 100 to 140.

Advantageous Effects

The washing machine configured as above, according to the embodiment of the present disclosure, can obtain an effect that increases the drive torque value of the motor by appropriately changing the wire diameter of the coil and the number of turns of the coil, without changing the reduction ratio of the planetary gear, the size of the drive motor, and the stacking height of the stator core.

In detail, in order to increase the number of turns of the coil, the wire diameter of the coil has to be reduced in a given slot fill condition. When the wire diameter of the coil decreases, resistance increases, causing a decrease in motor efficiency and an increase in motor temperature. However, according to the present disclosure, since the torque value of the motor is lowered by applying the planetary gear, it is confirmed that the input current value is lowered and thus there is no significant problem.

Meanwhile, when the number of turns of the coil increases, the counter electromotive force of the motor increases. As the counter electromotive force of the motor increases, the torque constant increases. Therefore, the torque value of the motor increases in the same current supply condition. However, when the counter electromotive force increases, the entry point of the field weakening control performed so as to increase the number of rotations of the motor in the spin-drying mode becomes faster.

When the number of turns of the coil excessively increases and thus the field weakening control is performed in the washing mode, the motor current is reduced and the torque of the drive motor is reduced. As a result, the adverse effect of deteriorating washing performance may be caused.

According to the present disclosure, the torque of the motor can be increased by adjusting the wire diameter of the coil and the number of turns of the coil within an appropriate range so that the adverse effect as described above does not occur.

BEST MODE

Hereinafter, a washing machine according to an embodiment of the present disclosure will be described in detail with reference to the accompanying drawings.

Figure 1:
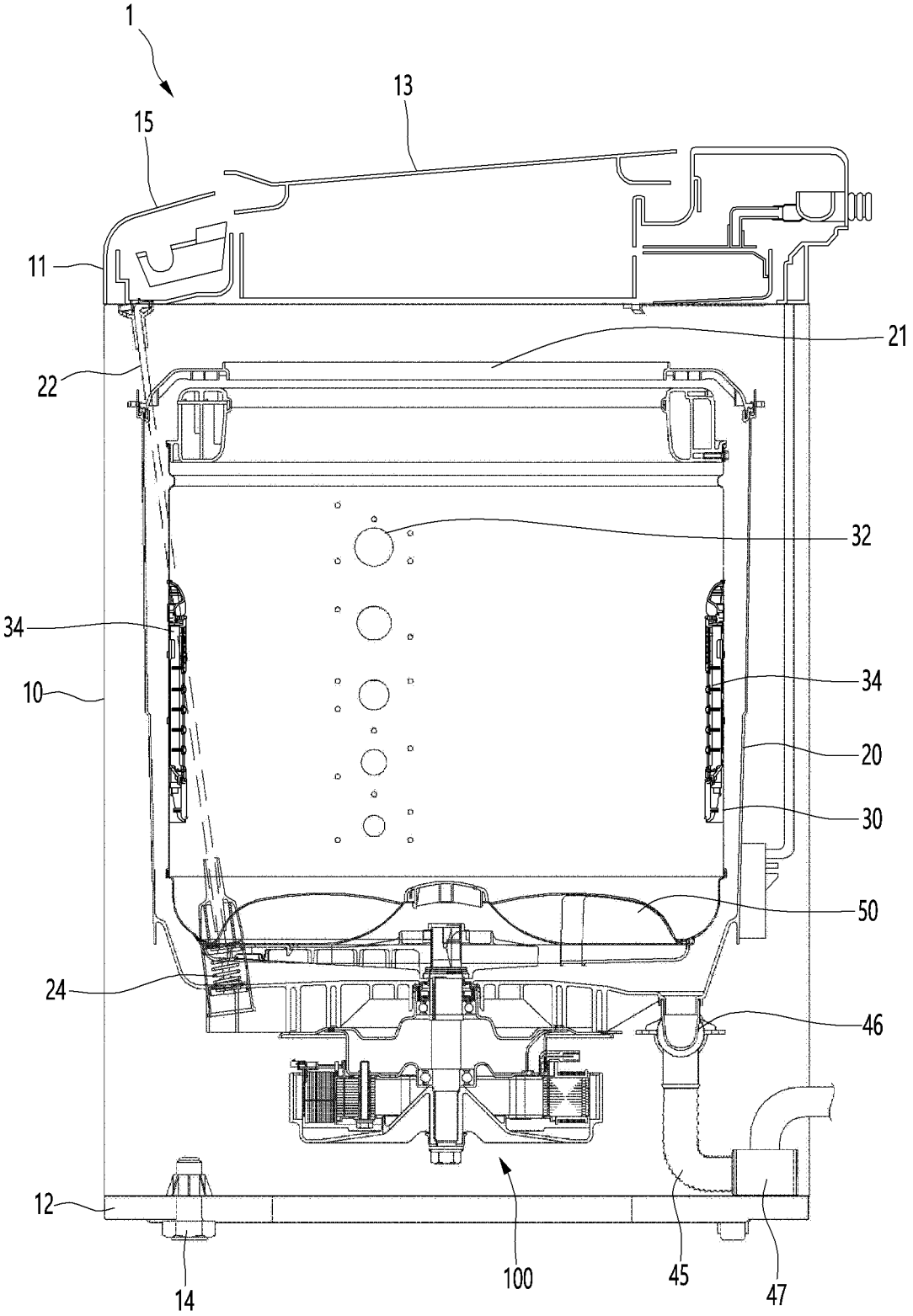
FIG. 1 is a cross-sectional view of a washing machine according to an embodiment of the present disclosure.

FIG. 1 is a cross-sectional view of a washing machine according to an embodiment of the present disclosure.

Referring to FIG. 1, a washing machine 1 according to an embodiment of the present disclosure may include a case 10 that forms an outer appearance, a top cover 11 disposed at an upper end of the case 10, and a base 12 disposed at a lower end of the case 10.

The case 10 is formed in a rectangular shape defining an internal space, and the upper and lower ends of the case 10 are opened. Various devices required for washing may be provided inside the case 10.

The top cover 11 is disposed at the opened upper end of the case 10 and defines a laundry inlet (not shown) into which laundry can be loaded. In addition, a door 13 capable of opening or closing the laundry inlet is provided at the upper side of the top cover 11. For example, the door 13 may be provided to be rotatable by a user.

The base 12 is disposed to shield the opened lower end of the case 10. One or more legs 14 are disposed on the bottom of the base 12 to separate the base 12 from the bottom surface. The horizontality of the washing machine 1 may be adjusted by rotating the legs 14. The base 12 may be provided with a shatterproof rib 300 according to an embodiment of the present disclosure. The shatterproof rib 300 will be described in detail with reference to the drawings.

In addition, the washing machine 1 is provided with a control panel 15 including various devices capable of controlling the washing machine 1. The control panel 15 may be provided on the upper surface of the top cover 11.

The control panel 15 may include various input interfaces provided to allow the user to operate the washing machine 1, and a display capable of showing the state of the washing machine 1 to the user. In addition, various PCBs (not shown) may be disposed on the control panel 15 so as to control the configuration of the washing machine 1 according to a signal input by the input interface.

A cylindrical outer tub 20 and an inner tub 30 are installed in the inner space of the washing machine 1 defined by the case 10, the top cover 11, and the base 12. The inner tub 30 has a smaller diameter than that of the outer tub 20 so as to be accommodated inside the outer tub 20.

The outer tub 20 is filled with wash water for washing fabrics. The outer tub 20 is formed in a cylindrical shape, and an opening 21 through which fabrics can enter and exit may be formed on the upper surface of the outer tub 20.

The outer tub 20 may be installed in a state of being spaced apart upward from the base 12 by a predetermined distance inside the case 10 by a support member 22. For example, the upper end of the support member 22 may be supported to the upper portion of the case 10, and the lower end of the support member 22 may be coupled to the lower portion of the outer tub 20. In addition, a damper 24 that absorbs vibrations generated in the outer tub 20 and the inner tub 30 may be provided at the lower end of the support member 22.

The damper 24 may include a spring that absorbs vibration generated in the inner tub 30 or the driver 100 through elastic deformation and transmitted to the outer tub 20.

The inner tub 30 may be defined as a washing tank that is rotated by the driver 100 for washing, rinsing, and spin-drying fabrics. The inner tub 30 may be accommodated inside the outer tub 20, and the outer surface of the inner tub 30 is installed to be spaced apart from the inner surface of the outer tub 2 by a predetermined distance.

A plurality of washing holes 32 through which wash water flows in and out are formed on the side surface of the inner tub 30. Therefore, the wash water supplied to the outer tub 20 may be filled in the inner tub 30 through the plurality of washing holes 32.

In addition, a filter 34 that collects various foreign substances including lint in wash water may be provided on the inner circumferential surface of the inner tub 30. A plurality of filters 34 may be installed in a circumferential direction of the inner tub 30.

Meanwhile, a water supply passage connected to an external water supply source to supply wash water to the outer tub 20 and the inner tub 30 is provided inside the washing machine 1. The water supply passage is provided with a water supply valve that opens or closes the water supply passage. A plurality of water supply valves may be provided according to the type of water to be supplied. For example, the water supply valve may include a hot water valve and a cold water valve.

In addition, a drainage passage 45 is provided inside the washing machine 1 to drain wash water from the outer tub 20 and the inner tub 30 to the outside of the washing machine 1. A drainage valve 46 that opens or closes the drainage passage 45 is provided in the drainage passage 45. In addition, a drainage pump 47 that pumps wash water drained along the drainage passage to the outside may be further provided at the end of the drainage passage 45.

In addition, the pulsator 50 forming a water flow for washing is rotatably provided on the bottom of the inner tub 30

In addition, a driver 100 that provides power for rotating the inner tub 30 or the pulsator 50 is provided inside the washing machine 1. The driver 100 includes a spin-drying shaft for rotating the inner tub 30 and a washing shaft for rotating the pulsator 50. The driver 100 selectively rotates the spin-drying shaft and the washing shaft.

Figure 2:
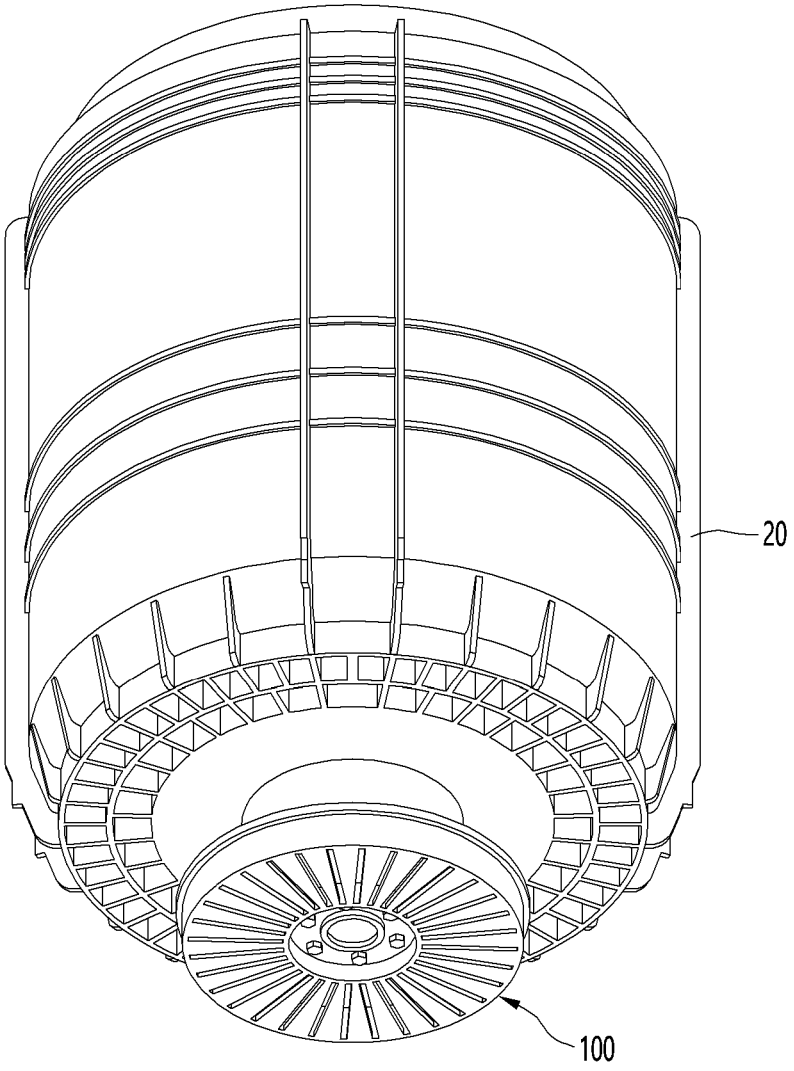
FIG. 2 is a perspective view showing a state in which a driver is installed in an outer tub, according to an embodiment of the present disclosure.
Figure 3:
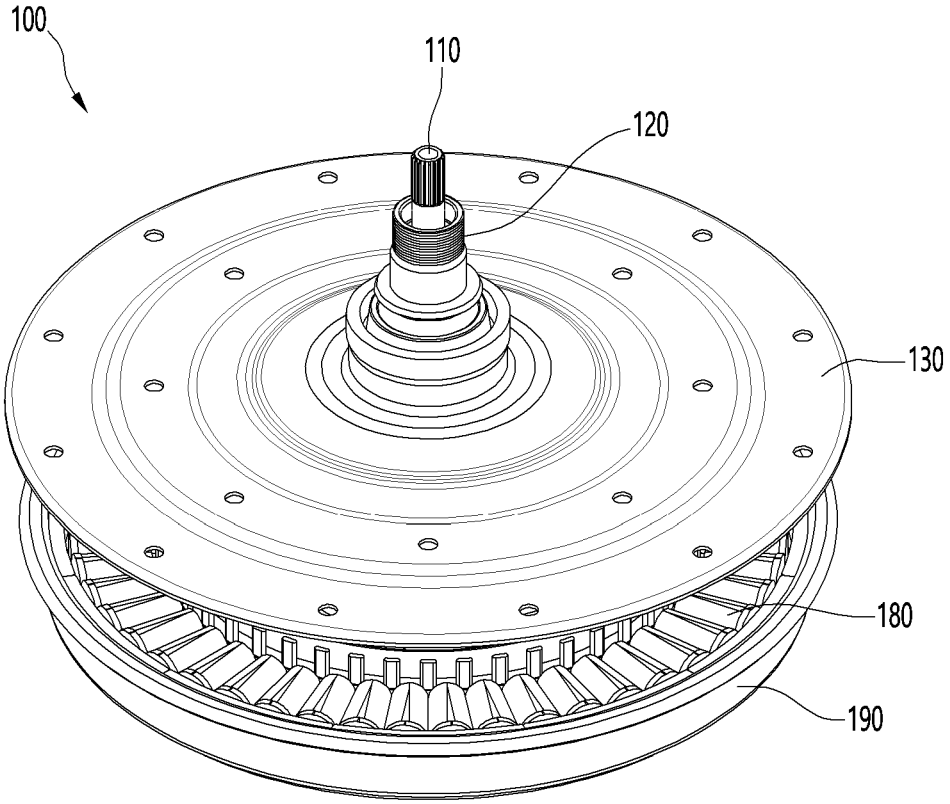
FIG. 3 is a perspective view of the driver.
Figure 4:
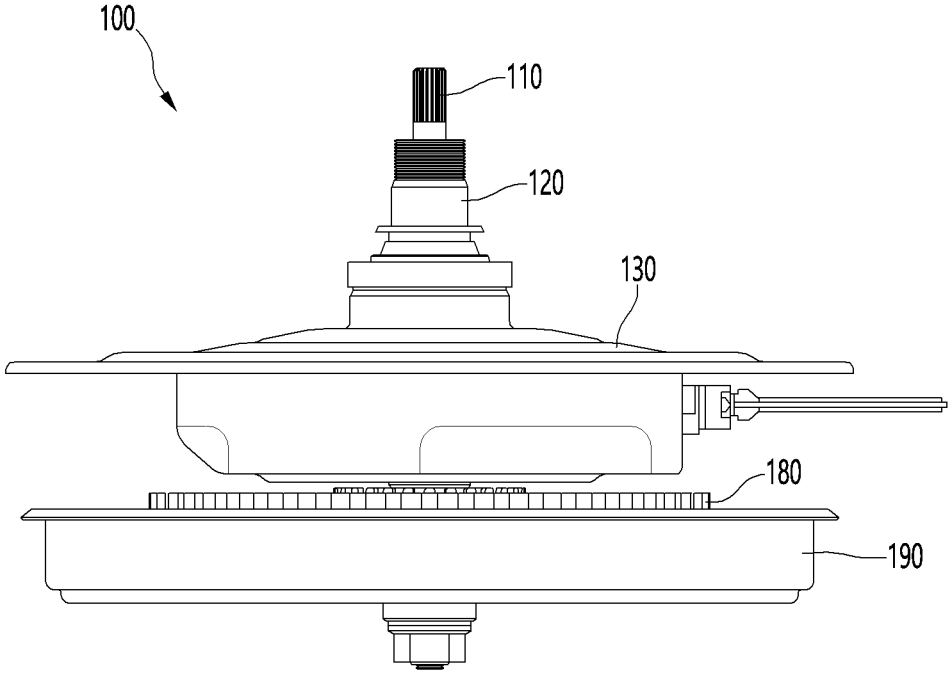
FIG. 4 is a side view of the driver.

FIG. 2 is a perspective view showing a state in which the driver is installed in the outer tub, according to an embodiment of the present disclosure, FIG. 3 is a perspective view of the driver, and FIG. 4 is a side view of the driver.

Referring to FIGS. 2 to 4, the driver 100 according to the embodiment of the present disclosure is disposed under the outer tub 20. The driver 100 may be understood as a device for providing power for rotating the pulsator 50 or simultaneously rotating the pulsator 50 and the inner tub 20.

The driver 100 may include a washing shaft 110 that transmits power to the pulsator 50, a spin-drying shaft 120 that transmits the rotational power to the inner tub 30, a bearing housing 130 that supports the washing shaft 110 and the spin-drying shaft 120, and drive motors 180 and 190 that are disposed under the bearing housing 130 to provide the driving force to the washing shaft 110 or the spin-drying shaft 120.

Hereinafter, the driver 100 will be described in more detail with reference to the accompanying drawings.

Figure 5:
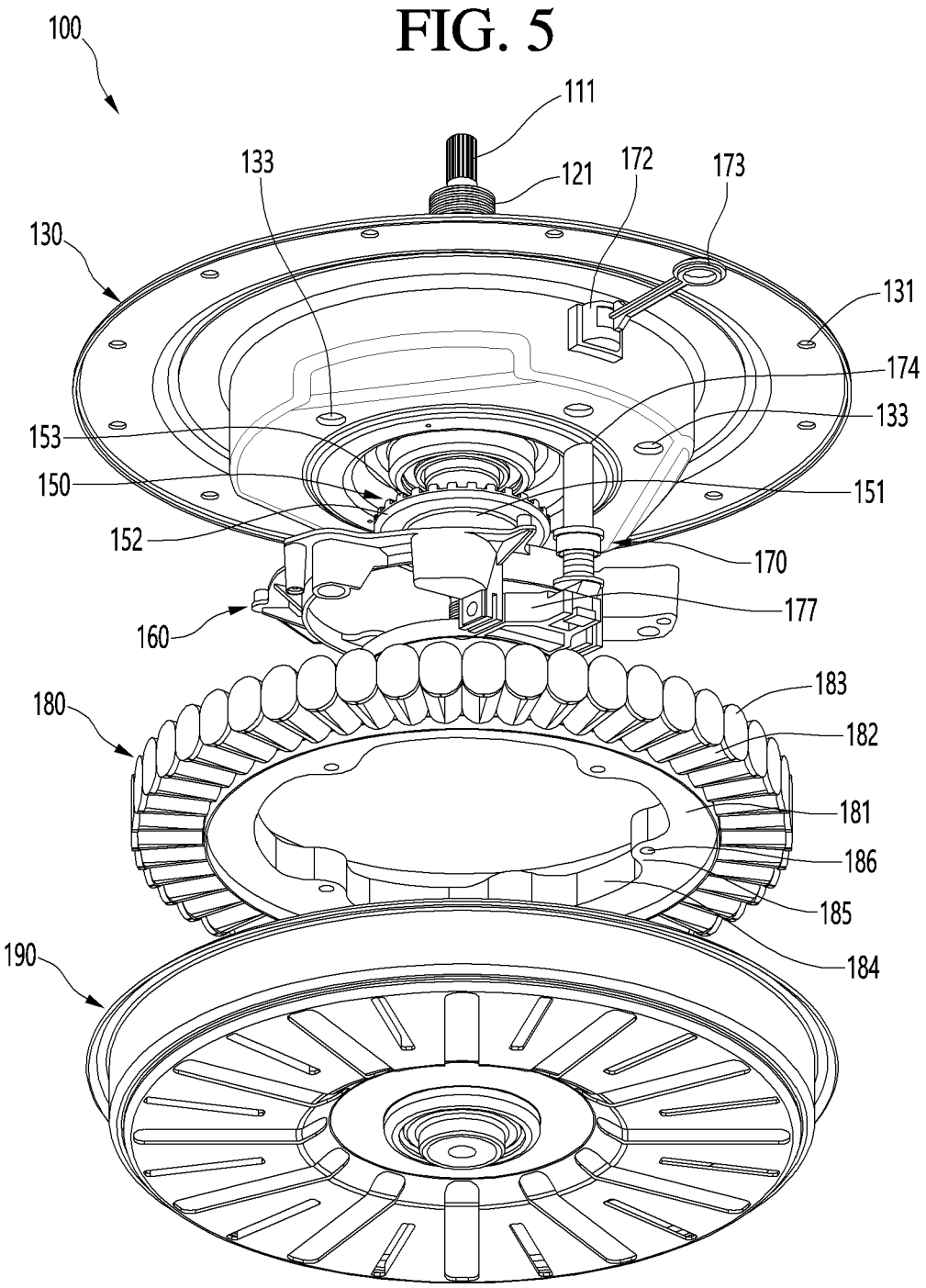
FIG. 5 is an exploded perspective view of the driver.
Figure 6:
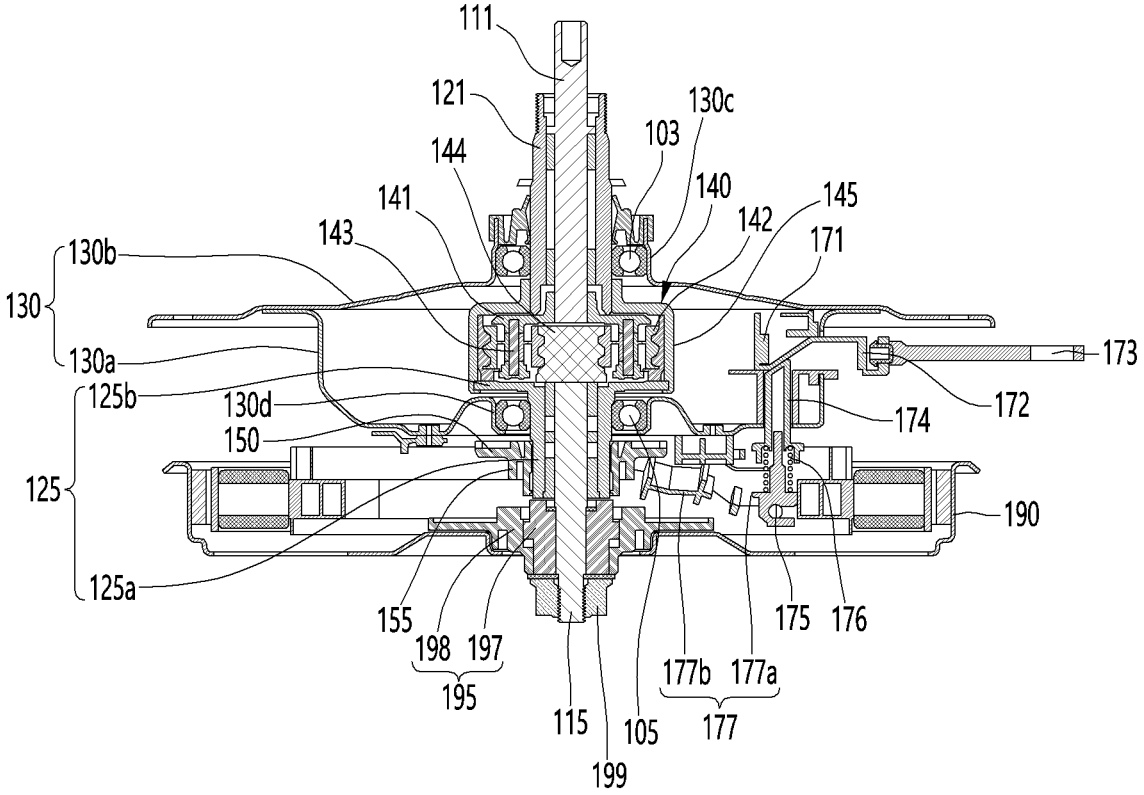
FIG. 6 is a longitudinal sectional view of the driver.
Figure 7:
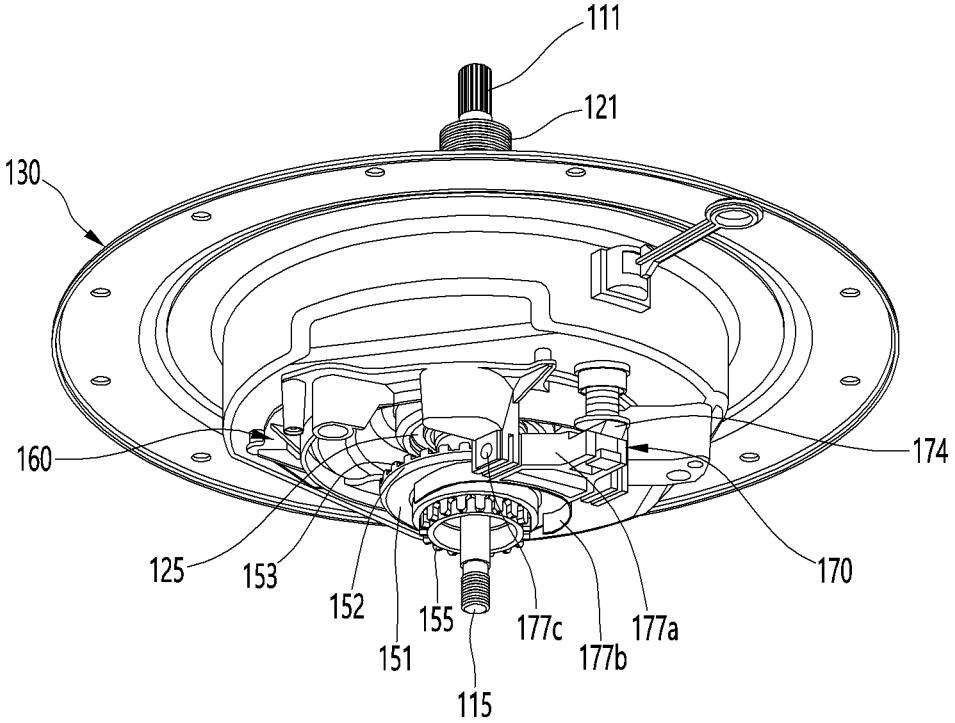
FIG. 7 is a perspective view showing a state in which drive motors are removed from the driver.
Figure 8:
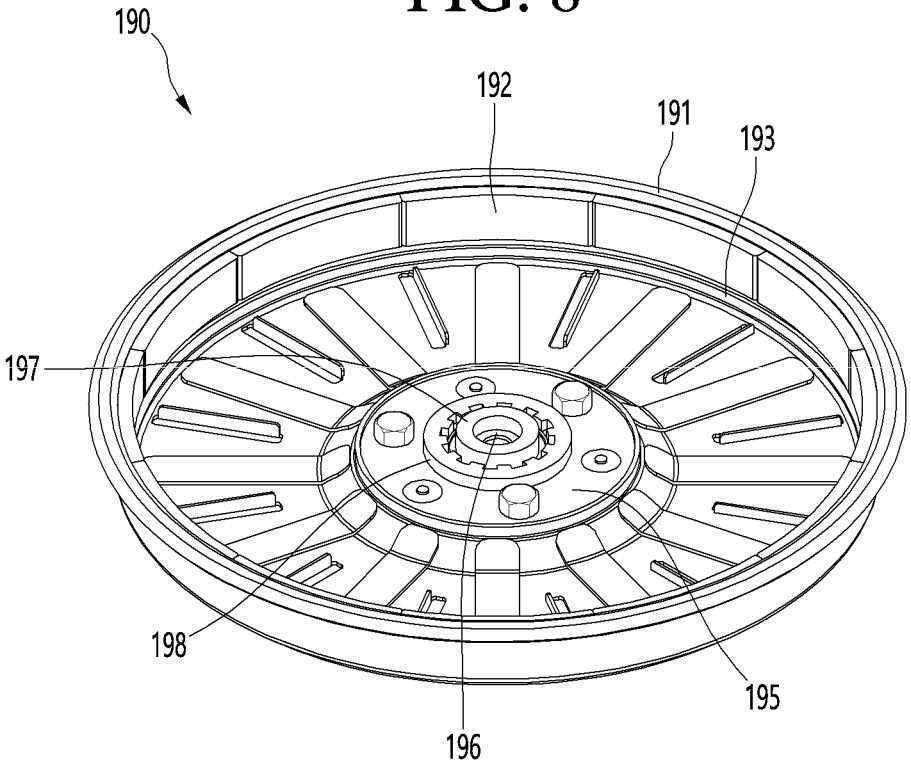
FIG. 8 is a perspective view of a rotor of the driver.

FIG. 5 is an exploded perspective view of the driver, FIG. 6 is a longitudinal sectional view of the driver, FIG. 7 is a perspective view showing a state in which the drive motors are removed from the driver, and FIG. 8 is a perspective view of a rotor of the driver.

Referring to FIGS. 5 to 8, the driver 100 includes the washing shaft 110, the spin-drying shaft 120, the bearing housing 130, and the drive motors 180 and 190, as described above.

In detail, the washing shaft 110 includes an upper washing shaft 111 and a lower washing shaft 115 disposed under the upper washing shaft 111. The spin-drying shaft 120 includes an upper spin-drying shaft 121 and a lower spin-drying shaft 125 disposed under the upper spin-drying shaft 121.

The upper washing shaft 111 passes through the center of the upper spin-drying shaft 120 and protrudes into the inner tub 30, and one end of the upper washing shaft 111 protruding into the inner tub 30 is coupled to the pulsator 50. The other end of the upper washing shaft 111 extends downward and is connected to a planetary gear module 140 disposed inside the bearing housing 130.

The upper washing shaft 111 is fixed to the bottom of the inner tub 30 and singularly rotates with the inner tub 30.

The lower washing shaft 115 is spaced downward from the upper washing shaft 111. The lower end of the lower washing shaft 115 is coupled to the rotor 190 of the drive motor, and the upper end of the lower washing shaft 115 is coupled to the planetary gear module 140. That is, the planetary gear module 140 connects the lower end of the upper washing shaft 111 to the upper end of the lower washing shaft 115.

The upper washing shaft 111 is inserted through the upper spin-drying shaft 121, and the upper spin-drying shaft 121 and the upper washing shaft 111 are coaxial. One end of the upper spin-drying shaft 121 is coupled to the inner tub 30 to transmit the rotational force to the inner tub 30, and the other end of the upper spin-drying shaft 121 is coupled to the planetary gear module 140.

The lower spin-drying shaft 125 is spaced downward from the upper spin-drying shaft 121. The lower washing shaft 115 is inserted through the lower spin-drying shaft 125, and the lower spin-drying shaft 125 and the lower washing shaft 115 are coaxial. The upper end of the lower spin-drying shaft 125 is coupled to the planetary gear module 140, and the lower end of the lower spin-drying shaft 125 is coupled to the rotor 190 by the coupler 150 to be described below, such that the lower spin-drying shaft 125 receives the rotational force. At this time, a serration for engaging with the coupler 150 is formed on the outer circumferential surface of the lower spin-drying shaft 125. Therefore, the coupler 150 is installed to be movable upward and downward along the lower spin-drying shaft 125.

According to the above-described configuration of the present disclosure, the rotational force generated by the drive motor is reduced through the planetary gear module 140 and transmitted to the upper washing shaft 111 and/or the upper spin-drying shaft 121. Therefore, the pulsator 50 or the inner tub 30 is rotated with a relatively high torque, thereby enabling efficient operation of the drive motor. Consequently, slimming of the drive motor can be achieved.

The bearing housing 130 supports the washing shaft 110 and the spin-drying shaft 120 and accommodates the planetary gear module 140 including a plurality of gears therein. The bearing housing 130 is disposed under the outer tub 20. The bearing housing 130 may be fixed to the bottom surface of the outer tub 20 by coupling members. A plurality of coupling holes 131 through which the coupling members pass may be formed at the upper edge of the bearing housing 130. The plurality of coupling holes 131 may be spaced apart in the circumferential direction of the housing 130. The coupling members passing through the coupling holes 131 are inserted in and fixed to the bottom surface of the outer tub 20.

The bearing housing 130 forms an inner space that accommodates the planetary gear module 140. In detail, the bearing housing 130 may include a housing case 130*a* accommodating the planetary gear module 140 in the inner center, and a housing cover 130*b* covering the opened upper surface of the housing case 130*a*. The plurality of coupling holes 131 may be disposed on the outer edge of the housing cover 130*b*.

In addition, a clutch stopper 160 may be coupled to the lower portion of the bearing housing 130 by the coupling member. In detail, a plurality of coupling holes 133 for inserting the coupling members may be formed on the bottom surface of the housing case 130*a*. As the coupling members pass through the clutch stopper 160 and are inserted into the coupling holes 133, the clutch stopper 160 may be mounted on the bottom surface of the bearing housing 130.

The plurality of coupling holes 133 may include three coupling holes, but the present disclosure is not limited thereto. The plurality of coupling holes 133 may be disposed at the same intervals.

Meanwhile, the upper washing shaft 111 and the upper spin-drying shaft 121 are inserted through the center of the upper surface of the bearing housing 130, that is, the center of the housing cover 130*b*.

In detail, a sleeve 130*c* for insertion of bearing may extend at the center of the housing cover 130*b*. The upper spin-drying shaft 121 passes through the sleeve 130*c* and is connected to the planetary gear module 140. An upper shaft support bearing 103 is disposed between the outer circumferential surface of the upper spin-drying shaft 121 and the sleeve 130*c*, such that the upper spin-drying shaft 121 is rotatably supported. The upper shaft support bearing 103 prevents frictional force from being generated between the upper spin-drying shaft 121 and the sleeve 130*c* when the upper spin-drying shaft 121 rotates.

In addition, the lower washing shaft 115 and the lower spin-drying shaft 125 are inserted through the center of the bottom surface of the bearing housing 130, that is, the center of the bottom of the housing case 130*a*. A sleeve 130*d* extends at the center of the bottom of the housing case 130*a*, and the lower spin-drying shaft 125 passes through the sleeve 130*d* and is connected to the planetary gear module 140. A lower shaft support bearing 105 is provided between the sleeve 130*d* and the lower spin-drying shaft 125 such that the lower spin-drying shaft 125 is rotatably supported.

The drive motor is disposed under the bearing housing 130. The drive motor includes a stator 180 that generates magnetic force by power applied thereto, and a rotor 190 that is rotated by induced electromotive force through interaction with the stator 180.

In detail, the stator 180 may include a stator core, an insulator 184 covering the upper and lower surfaces of the stator core, and a coil 182 wound around the stator core.

The stator core includes a yoke 181 formed in a circular strip shape, and a plurality of poles 183 extending radially from the outer edge of the yoke 181 and spaced apart in the circumferential direction.

The coil 182 is provided in the form of winding multiple times around the outer circumferential surface of the pole 183 covered by the insulator 184, thereby preventing direct contact between the coil 182 and the magnetic core.

The stator core is formed by laminating thin iron plates each including the yoke 181 and the pole 183 in multiple layers. It can be said that the torque of the drive motor is determined by the stacking height of the stator core and the number of turns of the coil 182.

In addition, a coupling protrusion 185 protruding in the center direction of the stator core is further included on the inner circumferential surface of the insulator. The coupling protrusion 185 is a part that couples the stator 180 to the bearing housing 130 by a coupling member.

A coupling hole 186 is formed in the coupling protrusion 185, and the coupling member passes through the coupling hole 186 and is inserted into the bottom surface of the bearing housing 130.

At this time, the clutch stopper 160 is disposed between the stator 180 and the bearing housing 130. The coupling member sequentially passes through the stator 180, the clutch stopper 160, and the bearing housing 130.

In addition, a plurality of coupling protrusions 185 may be disposed in the circumferential direction on the inner circumferential surface of the yoke 181. The plurality of coupling protrusions 185 may be disposed at the same intervals.

In FIG. 5, six coupling protrusions 185 are shown to be formed on the inner circumferential surface of the yoke 181. However, in the present disclosure, coupling members are inserted through only three coupling protrusions 185 among the six coupling protrusions 185. That is, the stator 180 is supported by being coupled to the bearing housing 130 at three points.

According to the three-point coupling structure, there is an advantage in that the vibration transmission amount is reduced compared with a conventional driver that forms a six-point coupling structure. In detail, when the vibration generated by the drive motor is transmitted to the bearing housing 130 through the clutch stopper 160, the vibration transmission amount is also reduced because the number of coupling members serving as the transmission medium decreases from 6 to 3.

The rotor 190 is a part that rotates due to an electrode difference from the stator 180. The rotor 190 is disposed to surround the outer circumferential surface of the stator 180. The rotor 190 may be formed in, for example, a flat cylindrical shape with an opened upper surface. The stator 180 may be placed inside the rotor 190 through the opened upper surface to form an outer rotor type motor.

In detail, referring to FIG. 8, the rotor 190 includes a rotor frame 191 forming an outer appearance, and a magnet 192 attached to the inner wall of the rotor frame 191. A stepped portion 193 on which the magnet 192 is placed to support the lower end of the magnet 192 is formed on the inner wall of the rotor frame 191.

In addition, a shaft coupling portion 195 for coupling with the lower washing shaft 115 and the lower spin-drying shaft 125 is provided at the central portion of the rotor 190. The shaft coupling portion 195 includes a shaft coupling boss 197 in which a shaft through-hole 196 through which the lower washing shaft 115 passes is formed, and an engaging portion 198 formed on the outside of the shaft coupling boss 197 and engaged with the serration of the coupler 150.

The shaft coupling portion 195 is fixedly coupled to the rotor 190 and rotated integrally with the rotor 190. A nut 199 is fitted to the end of the lower washing shaft 115 passing through the shaft coupling portion 195, such that the lower washing shaft 115 is rotated with the shaft coupling portion 195 and the rotor 190 as one body.

Meanwhile, the planetary gear module 140 constituting the driver 100 is a device for increasing the torque transmitted to the pulsator 50 by reducing the rotational force generated by the drive motor.

In detail, the planetary gear module 140 includes a planetary gear case 145, a sun gear 144 accommodated inside the planetary gear case 145, a plurality of planetary gears 142 engaged with the outer circumferential surface of the sun gear 144, and a carrier 141 supporting the plurality of planetary gears 142.

In more detail, a plurality of gear shafts 143 to which the planetary gears are fitted are disposed in the carrier 141 in the circumferential direction, and through-holes through which the gear shafts 143 pass are formed at the center of the planetary gear 142. Due to this structure, the carrier 141 can support the plurality of planetary gears 142, and can also rotate together with the planetary gear 142. The sun gear 144 is disposed at the center of the plurality of planetary gears 142, and the planetary gear 142 rotates in engagement with the sun gear 144. At the same time, the plurality of planetary gears 142 rotate in engagement with the serration formed on the inner circumferential surface of the planetary gear case 145.

The upper end of the lower spin-drying shaft 125 is fixed to the bottom surface of the planetary gear case 145, such that the lower spin-drying shaft 125 and the planetary gear case 145 rotate as one body. As shown, the lower spin-drying shaft 125 may include a cylindrical shaft portion 125*a* through which the lower washing shaft 115 passes, and a circular support portion 125*b* extending in a direction orthogonal to the shaft portion 125*a*, that is, in a horizontal direction, at the upper end of the shaft portion 125*a*. The support portion 125*b* forms the bottom surface of the planetary gear case 145 to support the sun gear 144 and the planetary gears 142. The upper end of the planetary gear case 145 is connected to the upper spin-drying shaft 121 as one body. A rounded octagonal groove may be formed on the upper portion of the carrier 141 and assembled with the lower end of the upper washing shaft 111. Therefore, the carrier 141 rotates with the upper washing shaft 111 as one body.

The sun gear 144 is connected to the upper end of the lower washing shaft 115. In a washing mode, the rotational force generated by the drive motor is transmitted through the lower washing shaft 115 to the sun gear 144, the planetary gear 142, the carrier 141, and the upper washing shaft 111 in this order. The rotational force generated by the drive motor is converted into the form in which the rotational speed is decreased but the torque is increased by the planetary gear module 140 and is transmitted to the upper washing shaft 111.

In addition, the driver 100 further includes the coupler 150. The coupler 150 may be coupled to the outer circumferential surface of the lower spin-drying shaft 125 to move in a vertical direction (up and down direction) along the lower spin-drying shaft 125. The coupler 150 moves vertically along the lower spin-drying shaft 125 to selectively transmit the rotational force caused by the rotation of the rotor 190 to the lower spin-drying shaft 125 and the lower washing shaft 115.

In detail, the coupler 150 includes a cylindrical body 151 having serrations on the upper and lower surfaces. A through-hole (not shown) through which the lower spin-drying shaft 125 pass is formed at the center of the body 151. A serration that is engaged with the outer circumferential surface of the lower spin-drying shaft 125 is formed on the inner circumferential surface of the through-hole.

In a state in which the serration formed on the inner circumferential surface of the through-hole is coupled to the serration formed on the outer circumferential surface of the lower spin-drying shaft 125, the coupler 150 is lowered along the lower spin-drying shaft 125 such that the serration formed on the bottom surface of the coupler 150 is coupled to the engaging portion 198 of the rotor 190. When the coupler 150 is lifted, the engaging portion 198 of the rotor 190 and the serration formed on the lower surface of the coupler 150 are separated from each other.

A flange portion 152 extending in the radial direction of the body 151 is formed at the upper end of the body 151. A stop gear 153 may be formed at the edge of the upper surface of the flange portion 152 in the circumferential direction. In addition, a connecting gear 155 engaged with the engaging portion 198 of the shaft coupling portion 195 is formed at the edge of the lower end of the body 151 in the circumferential direction.

A compression spring (not shown) that pushes the coupler 150 downward when switching from a washing mode to a spin-drying mode is provided between the upper surface of the coupler 150 and the lower shaft support bearing 105.

In addition, the driver 100 may further include a clutch mechanism 170 that switches a power transmission path of the drive motor to the washing shaft 110 or the spin-drying shaft 120 in response to a washing cycle or a spin-drying cycle. The clutch mechanism 170 functions to elevate the coupler 150 to an ascending position by the operation of the clutch motor.

In detail, the clutch mechanism 170 may include a clutch motor (not shown) installed at the lower portion of the outer tub 20, a cam (not shown) coupled to the driving shaft of the clutch motor, a lever guide 171 fixed to the inside of the bearing housing 130, and a lever 172 guided by a lever guide 171 to linearly reciprocate when the clutch motor is turned on or off.

In addition, the clutch mechanism 170 may further include a connecting rod 173 installed between the cam and the lever 172 of the clutch motor, and a return spring (not shown) that provides a return force to the lever. In detail, the connecting rod 173 serves to pull the lever 172 toward the clutch motor according to the driving of the clutch motor. One end of the return spring is fixed to the lever guide 171, and the other end of the return spring is fixed to the lever 172.

In addition, the clutch mechanism 170 may further include a mover 174 that is lowered along the inclined surface of the lever 172 when the clutch motor is turned on, a plunger 175 that moves vertically along a guide groove inside the mover 174, and a buffer spring 176 provided on the outer circumferential surface of the plunger 175.

A clutch lever 177 that substantially supports the coupler 150 is provided at the lower end of the plunger 175. One end of the clutch lever 177 is coupled to the plunger 175, and the other end of the clutch lever 177 is in contact with the coupler 150. The clutch lever 177 functions to elevate the coupler 150.

In detail, the clutch lever 177 may include a connecting portion 177*a* coupled to the end of the plunger 175, a support portion 177*b* extending from the connection portion 177*a* toward the coupler 150, and a fixing pin 177*c* extending from both side edges of the connecting portion 177*a* to become the center of rotation of the clutch lever. The fixing pin 177*c* may be defined as a hinge shaft.

One end of the connecting portion 177*a* is connected to the end of the plunger 175, and the support portion 177*b* is formed at the other end of the connecting portion 177*a*. The connecting portion 177*a* and the support portion 177*b* may be formed horizontally. The fixing pin 177*c* passes through the connecting portion 177*a* in the horizontal direction and is coupled to the clutch stopper 160 to be described below. That is, the support portion 177*b* is hinged to the clutch stopper 160 by the fixing pin 177*c* and is installed to be rotated by a certain amount.

The support portion 177*b* protrudes from the end of the connecting portion 177*a* toward the coupler 150 and functions to elevate the coupler 150. The support portion 177*b* functions to press the coupler 150 to the ascending position when switching to the washing mode.

The support portion 177*b* extends from the end of the connecting portion 177*a* toward the coupler 150 in both directions, such that the support portion 177*b* and the connecting portion 177*a* form a 'Y' shape. Two ends of the extended support portion 177*b* may be disposed to surround the edge of the coupler 150.

For example, at least part of the support portion 177*b* may surround the outer circumferential surface of the body 151 of the coupler 150. Part of the upper surface of the support portion 177*b* may be in contact with the lower surface of the flange portion 151 of the coupler 150. At this time, the support portion 177*b* may be disposed in the form of hanging on the outer circumferential surface of the coupler 150, or may be fixed to part of the outer circumferential surface of the coupler 150. That is, the support portion 177*b* may be in contact with the coupler 150 by various methods.

In addition, the driver 100 may further include the clutch stopper 160 that limits the amount of rotation of the clutch lever 177. The clutch stopper 160 functions to suppress the movement of the coupler 150 such that impact is not applied to the clutch motor, the washing shaft 110, or the spin-drying shaft 120 due to the rotation of the coupler 150 after the coupling between the coupler 150 and the rotor 190 is released.

The clutch stopper 160 is fixed to the bottom surface of the bearing housing 130 by the coupling member.

In addition, the clutch stopper 160 is hinged such that the clutch lever 177 is rotatable. The clutch stopper 160 guides the clutch lever 177 to stably lift or lower the coupler 150.

Hereinafter, the operation of the driver will be described in detail with reference to the accompanying drawings.

First, the operation of the driver according to the washing cycle (or the washing mode) will be described with reference to FIG. 6.

When a washing command is input to the washing machine 1, the clutch motor of the clutch mechanism 170 is turned on. When the clutch motor is turned on, the connecting rod 173 is pulled toward the clutch motor such that the lever 172 is pulled together.

When the lever 172 is pulled toward the clutch motor, the mover 174 is lowered along the inclined surface of the lever 172. At this time, when the plunger 175 is lowered together with the mover 174, the clutch lever 177 is rotated upward by the pushing force of the plunger 175.

At this time, as the clutch lever 177 is lifted, the clutch lever 177 pushes the coupler 150 upward, such that the coupler 150 is lifted along the lower spin-drying shaft 125. The coupling between the coupler 150 and the rotor 190 is released, and the coupling between the coupler 150 and the lower spin-drying shaft 125 is made. In this case, the coupler 150 deviates from the rotor 190 and only the washing shaft 110 is rotated when the rotor 190 is rotated.

That is, in the washing mode, the serration formed on the inner circumferential surface of the coupler 150 is engaged with only the serration formed on the outer circumferential surface of the lower spin-drying shaft 125 and is not engaged with the serration of the engaging portion 198 engaged with the lower washing shaft 115. Therefore, the rotational force of the rotor 190 is transmitted to only the pulsator 50 through the washing shaft 110.

The rotational force transmission process of the rotor 190 in the washing mode will be described in detail. The rotational force generated by the rotor 190 is sequentially transmitted to the shaft coupling boss 197 of the rotor 190, the lower washing shaft 115 coupled to the shaft coupling boss 197, the sun gear 144, the planetary gear 142, the carrier 141, and the upper washing shaft 111.

Meanwhile, the operation of the driver according to the spin-drying cycle (or the spin-drying mode) will be described with reference to the accompanying drawings.

Figure 9:
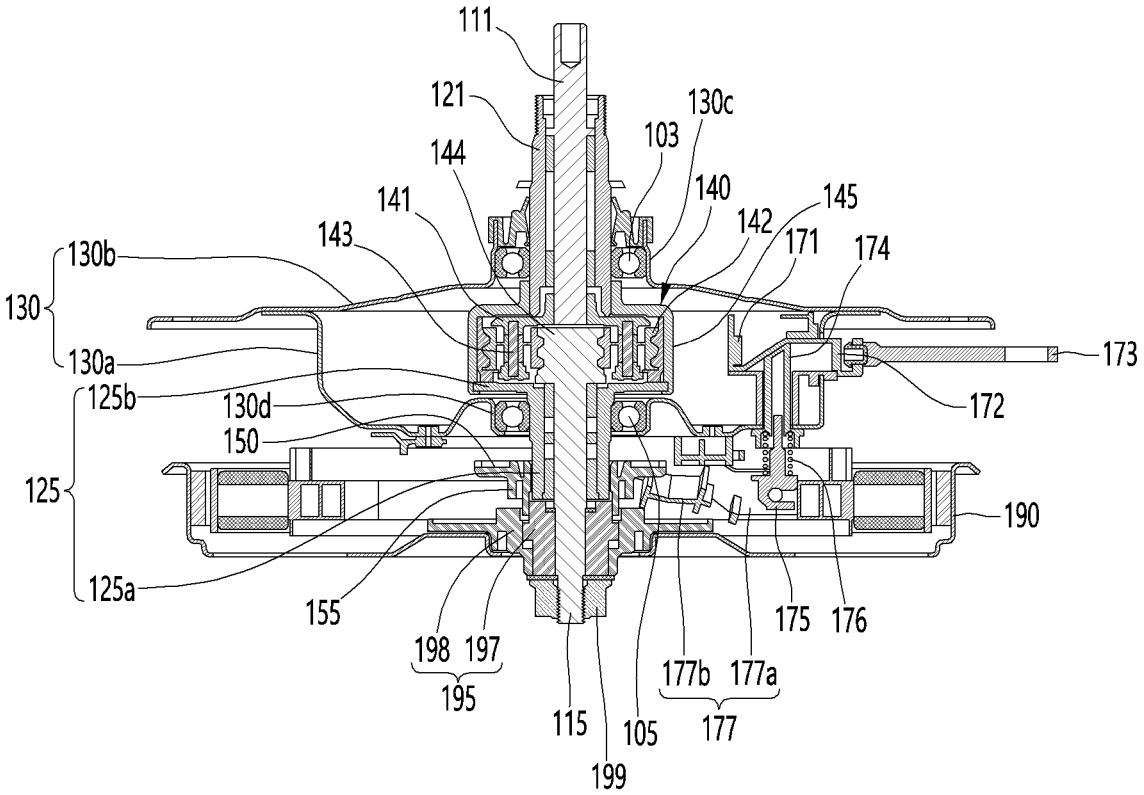
FIG. 9 is a longitudinal sectional view showing the driver in a spin-drying mode, according to an embodiment of the present disclosure.

FIG. 9 is a longitudinal sectional view showing the driver in the spin-drying mode, according to an embodiment of the present disclosure.

Referring to FIG. 9, when a spin-drying command is input to the washing machine 1, the clutch motor of the clutch mechanism 170 is turned off. When the clutch motor is turned off, the connecting rod 173 pulled toward the clutch motor returns to its original position and the mover 174 is lifted along the inclined surface of the lever 172. At this time, when the plunger 175 is lifted together with the mover 174, the clutch lever 177 rotates downward.

At this time, as the clutch lever 177 is lowered, the coupler 150 is lowered due to its own weight and the pushing force of the compression spring. When the coupler 150 is completely lowered along the lower spin-drying shaft 125, the connecting gear 155 formed at the lower portion of the coupler 150 is engaged with the engaging portion 198 of the rotor 190.

That is, when the coupler 150 is completely lowered, the coupler 150 is in a state of being connected to the rotor 190 and the lower spin-drying shaft 125. In this case, since the coupler 150 simultaneously transmits the rotational force generated by the rotor 190 to the lower washing shaft 115 and the lower spin-drying shaft 125, the washing shaft 110 and the spin-drying shaft 120 are rotated at high speed and spin-drying is performed.

In addition, since the washing shaft 110 and the spin-drying shaft 120 rotate as one body, when the sun gear 144 inside the planetary gear module 140 rotates with the lower washing shaft 115, the planetary gear 142 does not rotate and revolves around the sun gear 144 in a state of being engaged with the sun gear 144. Therefore, the washing shaft 110 and the spin-drying shaft 120 rotate at the same rotational speed.

Hereinafter, the clutch stopper will be described in detail with reference to the accompanying drawings.

Figure 10:
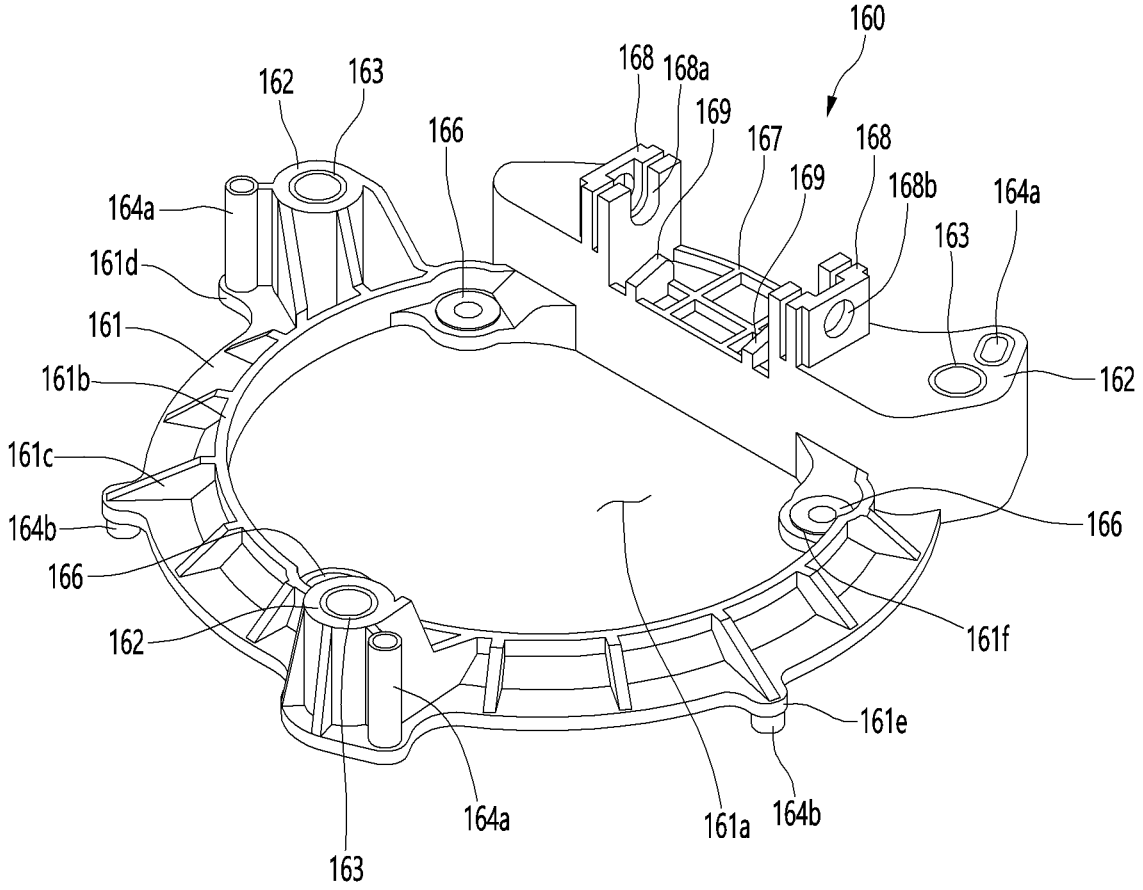
FIG. 10 is a bottom perspective view of a clutch stopper according to an embodiment of the present disclosure.
Figure 11:
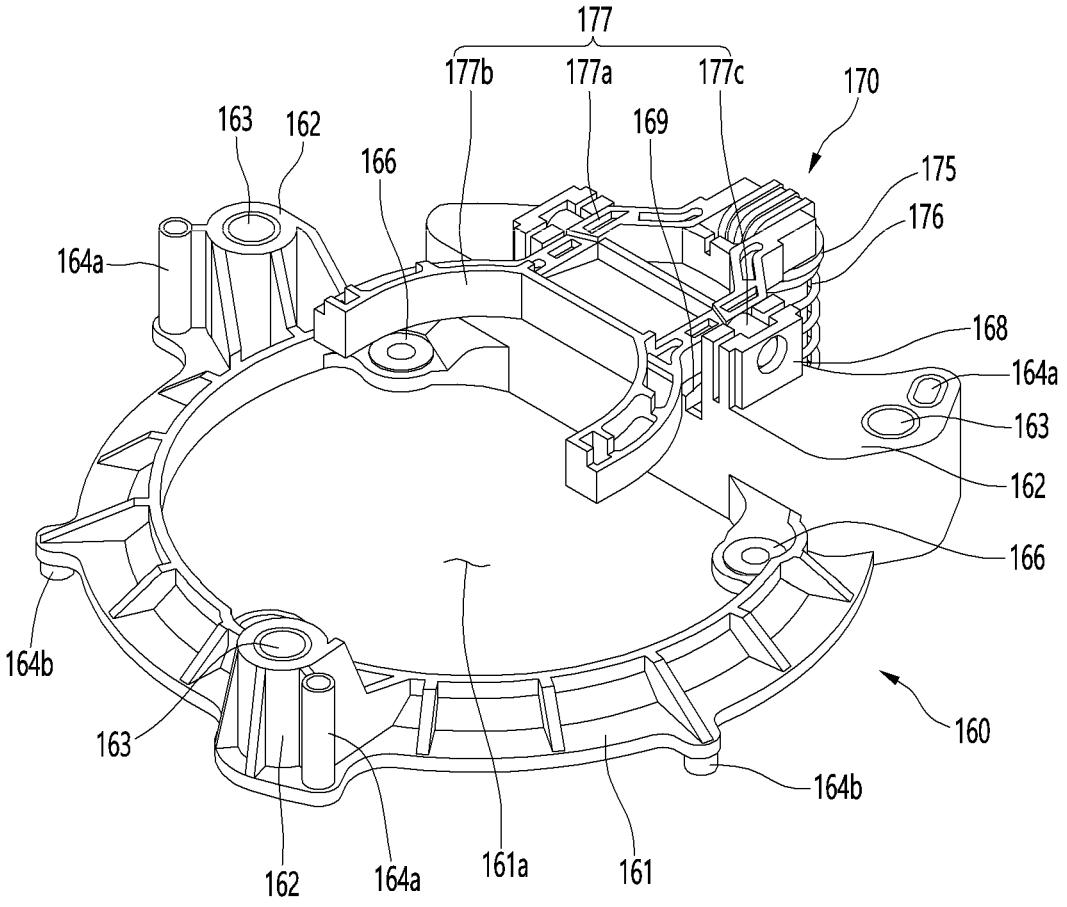
FIG. 11 is a bottom perspective view of the clutch stopper to which a clutch lever is coupled.
Figure 12:
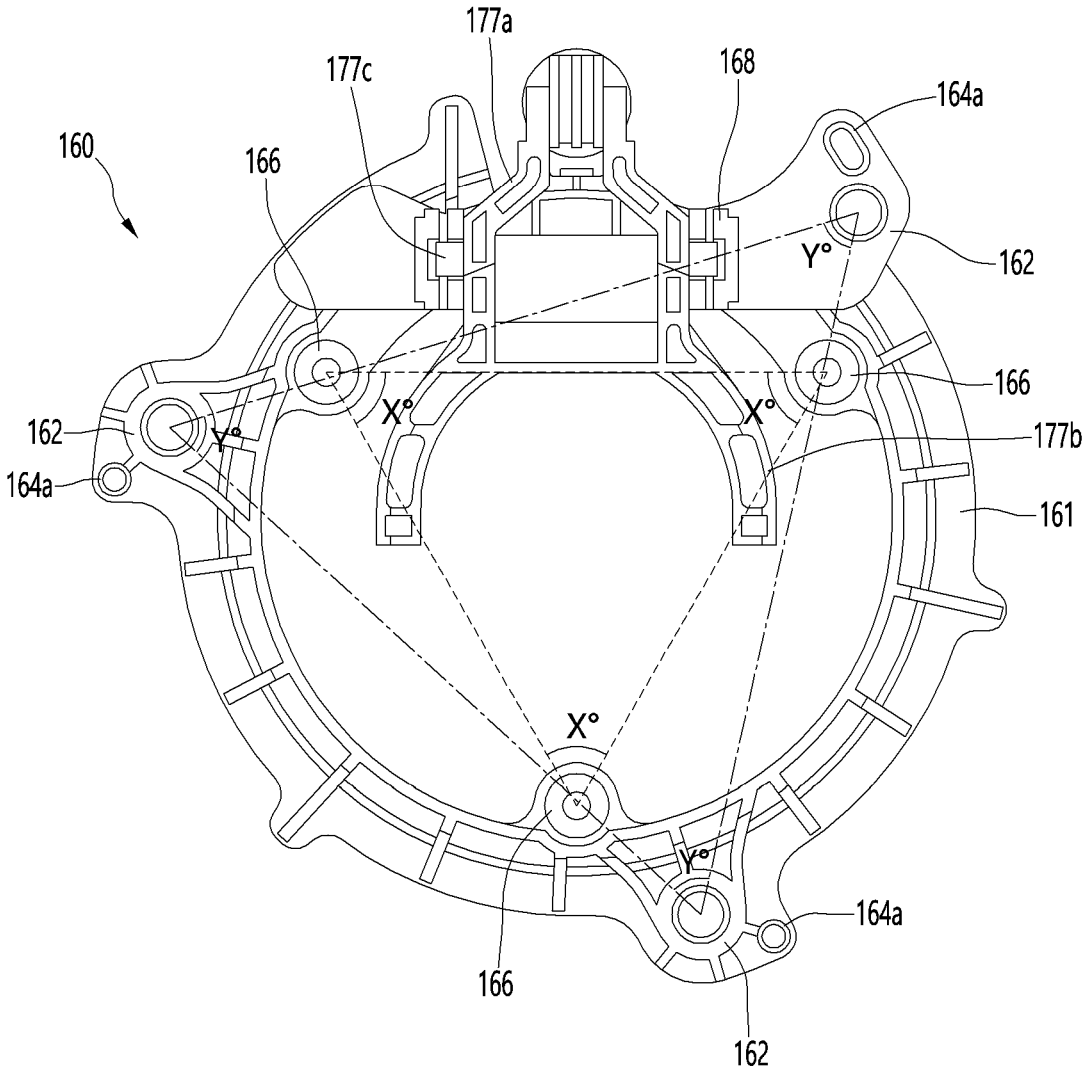
FIG. 12 is a bottom view of the clutch stopper shown in FIG. 11.
Figure 13:
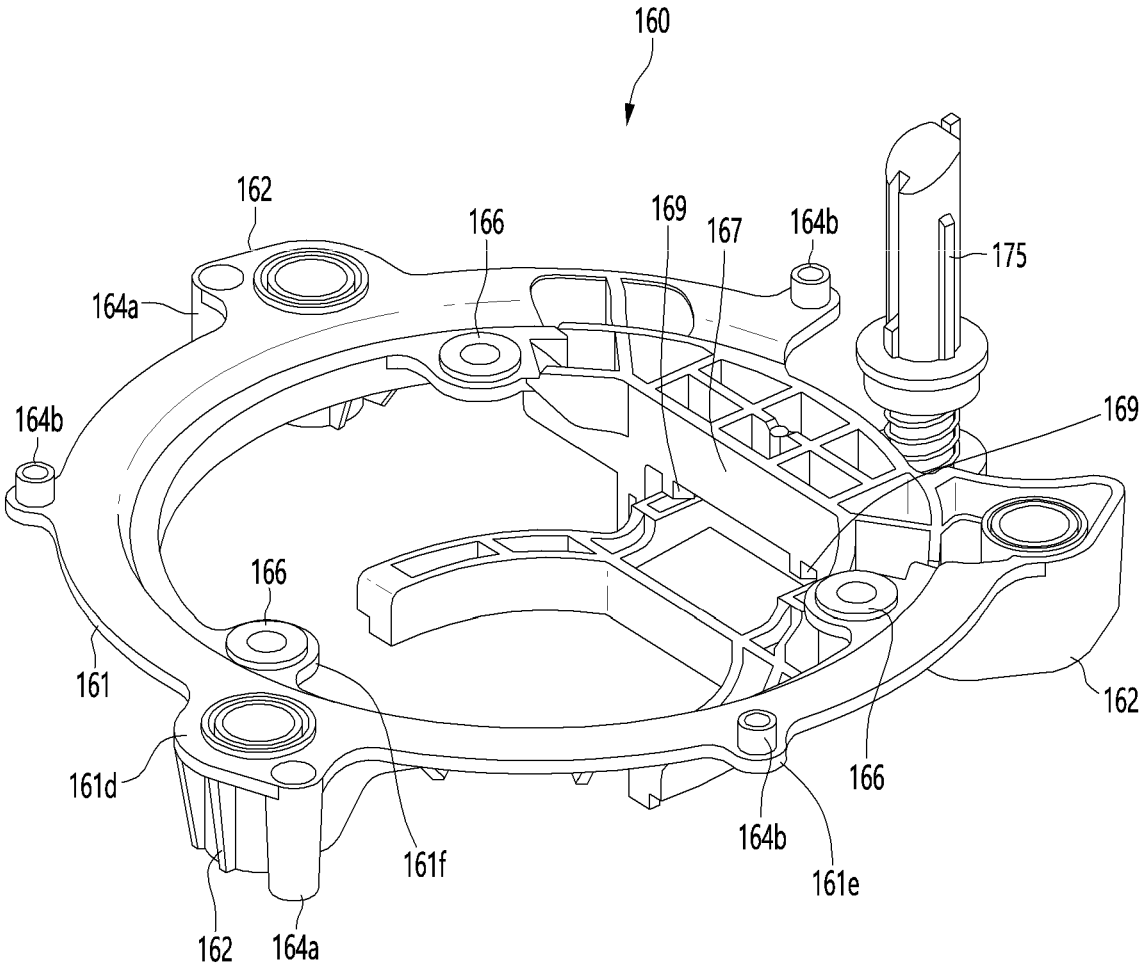
FIG. 13 is a plan perspective view of the clutch stopper to which the clutch lever is coupled.

FIG. 10 is a bottom perspective view of the clutch stopper according to an embodiment of the present disclosure, FIG. 11 is a bottom perspective view of the clutch stopper to which the clutch lever is coupled, FIG. 12 is a bottom view of the clutch stopper shown in FIG. 11, and FIG. 13 is a plan perspective view of the clutch stopper to which the clutch lever is coupled.

As described above, the clutch stopper 160 is disposed under the bearing housing 130, and the drive motor including the stator 180 is disposed under the clutch stopper 160. That is, the clutch stopper 160 shown in FIGS. 10 to 12 is a perspective view showing an upside-down view, and when mounted on the washing machine, the clutch stopper 160 is mounted on the bottom surface of the bearing housing 130 in the state of FIG. 13.

The clutch stopper 160 is installed between the bearing housing 130 and the stator 180 and serves as a damper that reduces the transmission of vibrations caused by the rotation of the stator 180 toward the bearing housing 130 side. The clutch stopper 160 is made of a plastic resin material and may be integrally injection-molded.

Referring to FIGS. 10 to 13, the clutch stopper 160 includes a base portion 161 in which an opening 161*a* is formed inside. The opening 161*a* may be understood as a hole through which the lower spin-drying shaft 125 extending from the lower portion of the bearing housing 130 passes. For example, the opening 161*a* may be formed in a circular shape, but may also be formed in a non-circular shape or a polygonal shape.

The base portion 161 may be formed in a disc shape. At this time, the outer diameter of the base portion 161 may be smaller than the inner diameter of the stator 180.

On the inner edge of the base portion 161, an extension portion 161*b* extends upward in a sleeve form on the drawing, and when mounted on the bearing housing 130, the extension portion 161*b* extends downward. A plurality of reinforcing portions 161*c* may extend radially from the bottom surface (upper surface in the drawing) of the base portion 161, and the plurality of reinforcing portions 161*c* may be spaced apart in the circumferential direction of the opening 161*a*. The reinforcing portion 161*c* functions to connect the outer circumferential surface of the extension portion 161*b* to the bottom surface of the base portion 161 to improve the strength of the base portion 161 and to disperse stress.

In addition, a plurality of main flanges 161*d* and a plurality of dummy flanges 161*e* may protrude from the outer edge of the base portion 161. The plurality of main flanges 161*d* and the plurality of dummy flanges 161*e* may be alternately spaced in the circumferential direction of the base portion 161. For example, three main flanges 161*d* and three dummy flanges 161*e* may be provided, but the present disclosure is not limited thereto.

In addition, a plurality of inner flanges 161*f* may extend from the inner edge of the base portion 161.

A coupling boss 162 for fixing to the bearing housing 130 extends from the bottom surface of the main flange 161*d*. A coupling member passing through the stator 180 passes through the coupling boss 162 and is coupled to the bearing housing 130, such that the bearing housing 130, the clutch stopper 160, and the stator 180 are fixed together.

Since the coupling boss 162 extends a certain length from the bottom surface of the base portion 161, the stator 180 may contact only the end of the coupling boss 162 to minimize vibration transmission. In order to minimize the contact area between the upper surface of the base portion 161 and the bottom surface of the bearing housing 130, a sleeve may protrude from the upper surface of the base portion 161 corresponding to the upper surface of the coupling boss 162 to a thickness of about 1 mm. The coupling member may pass through the sleeve and be fixed to the bottom surface of the bearing housing 130.

Due to this configuration, the contact area between the clutch stopper 160 and the bearing housing 130 is minimized, thereby minimizing the phenomenon that the vibration generated by the drive motor is transmitted to the bearing housing 130 through the clutch stopper 160.

While a conventional stator is coupled to the clutch stopper at six points and thus supported, the stator 180 according to the present disclosure is coupled to the clutch stopper 160 at three points and thus supported. That is, in the case of the present disclosure, since the vibration generated by the stator 180 is less transmitted to the clutch stopper 160, the noise is greatly reduced.

In the conventional case, the stator is coupled in direct contact with the base surface of the clutch stopper. In the case of the present disclosure, the stator 180 is coupled to the coupling boss 162 protruding from the base portion 161 to a certain height. Therefore, the vibration generated by the stator 180 is prevented from being directly transmitted to the clutch stopper 160, thereby reducing the vibration and noise.

In addition, in the present disclosure, a sleeve pipe 163 is inserted into the coupling boss 162 to improve the coupling force of the coupling member. The sleeve pipe 163 may be inserted into the coupling boss 162 by insert injection.

The sleeve pipe 163 is provided in a hollow cylindrical shape and is made of a metal material. The sleeve pipe 163 is a portion through which the coupling member substantially passes. The sleeve pipe 163 is inserted into the through-hole of the coupling boss 162, thereby improving the strength of the coupling boss 162 and improving the coupling force of the coupling member. That is, even if the coupling force is increased by tightening the coupling member passing through the coupling boss 162 to an appropriate level or more, it is possible to prevent the coupling boss 162 from being damaged.

In more detail, the coupling boss 162 is made of a plastic material. In this case, the coupling boss 162 may reduce the strength of the coupling boss 162 and the coupling force of the coupling member due to plastic expansion or contraction according to a temperature change. Therefore, in the present disclosure, in order to prevent a reduction in strength and coupling force that may occur due to the temperature change in the plastic material, the sleeve pipe made of the metal material may be applied to maintain a constant coupling force.

In addition, the base portion 161 is provided with a plurality of guide portions 164 that facilitate position alignment between relative structures (e.g., stator, bearing housing, etc.). The guide portion 164 may be understood as a structure that guides position alignment for assembly (coupling) between the clutch stopper 160 and the bearing housing 130 and/or the stator 180.

In detail, the guide portion 164 may include a lower guide portion 164*a* extending from the bottom surface of the base portion 161 and an upper guide portion 164*b* extending from the upper surface of the base portion 161.

The lower guide portion 164*a* may be formed on the bottom surface of the main flange 161*d*, or may be formed on the side of the coupling boss 162.

In the present embodiment, the lower guide portion 164*a* may be disposed at a position adjacent to the coupling boss 162. Due to this configuration, the lower guide portion 164*a* may facilitate position alignment for assembly between the clutch stopper 160 and the stator 180. To this end, a hole or a groove into which the lower guide portion 164*a* is inserted is formed at the inner edge of the stator 180.

The upper guide portion 164*b* may extend from the upper surface of the dummy flange 161*e*. Therefore, the upper guide portion 164*b* may facilitate position alignment for assembly between the clutch stopper 160 and the bearing housing 130.

In addition to the bearing housing 130 according to the present disclosure, six coupling holes 133 are formed on the bottom surface of the conventional bearing housing. In addition to the stator 180 according to the present disclosure, six coupling protrusions 185 protrude from the inner edge of the conventional stator. The coupling hole 186 is formed in each coupling protrusion 185.

The coupling member passing through the coupling hole 186 passes through the coupling boss 162 and is inserted into the coupling hole 133 formed at the bottom of the bearing housing 130.

Unlike the structure of the conventional clutch stopper, in the clutch stopper 160 according to the embodiment of the present disclosure, only three coupling bosses 162 function as a connecting portion connecting the stator 180 to the bearing housing 130, and the three upper guide portions 164*b* function as shielding device that shields the remaining three coupling holes 133.

That is, the three upper guide portions 164*b* may be inserted into the three coupling holes 133 among the six coupling holes 133 to facilitate position alignment of the clutch stopper 160. As a result, it can be said that the stator 180 is supported at three points on the bottom surface of the bearing housing 130.

In addition, since the upper guide portion 164*b* is inserted into the coupling hole 133 formed on the bottom surface of the bearing housing 130, the coupling member is blocked by the dummy flange 161*e* and is thus no longer inserted even if the coupling member is inserted into the through-hole other than the through-holes corresponding to the coupling bosses 162 among the six through-holes 185 formed at the inner edge of the stator 180. Therefore, it is possible to prevent an assembler from being confused to perform defective assembly.

In addition, an auxiliary coupling portion 166 may be further formed on the upper surface of the inner flange 161*f*. When the clutch stopper 160 is coupled to the bottom surface of the bearing housing 130, a coupling hole may be formed on the bottom surface of the bearing housing 130 corresponding to the position of the auxiliary coupling portion 166. The coupling member passes through the auxiliary coupling portion 166 and is inserted into the bearing housing 130, such that the clutch stopper 160 is supported at six points on the bottom surface of the bearing housing 130. Therefore, the clutch stopper 160 to which the stator 180 is coupled on the bottom surface may be stably coupled and supported to the bottom surface of the bearing housing 130.

The auxiliary coupling portion 166 may also protrude about 1 mm from the upper surface of the inner flange 161*f*, thereby minimizing the contact area between the upper surface of the base portion 161 and the bottom surface of the bearing housing 130.

In addition, a seating portion 167 on which the clutch lever 177 is seated is further formed on the bottom surface (upper surface in FIG. 10) of the base portion 161. The seating portion 167 is formed to have a certain width such that the clutch lever 177 for lifting the coupler 150 is positioned.

A hinge coupling portion 168 to which the clutch lever 177 is rotatably coupled is formed on the left and right edges of the seating portion 167. In detail, the hinge coupling portion 168 further extends downward from both side ends of the seating portion 167. A seating groove 168*a* in which the fixing pin 177*c* of the clutch lever 177 is seated and a hinge hole 168*b* into which the fixing pin 177*c* is inserted are formed at the end of the hinge coupling portion 168.

In addition, one or more stopper ribs 169 may protrude from the seating portion 167 so as to maintain a constant amount of rotation (rotation angle) of the clutch lever 177. In the present embodiment, an example in which the pair of stopper ribs 169 protrude will be described below. The stopper rib 169 is configured to substantially contact the upper surface of the connecting portion 177*a* constituting the clutch lever 177. That is, the bottom surface of the stopper rib 169 is at least partially in contact with the upper surface of the connecting portion 177*a*.

The end of the stopper rib 169 may be inclined upward toward the center of the clutch stopper 160. That is, the stopper rib 169 may be formed to have an inclined surface inclined upward from the outside to the inside.

Meanwhile, the driver 100 according to the embodiment of the present disclosure applies a planetary gear having a reduction ratio of 3.8:1 (one rotation of the pulsator relative to 3.8 rotations of the motor), such that the washing performance is maintained even when the torque of the drive motor is lowered. That is, since the drive motor having low performance can be applied, the manufacturing cost of the washing machine can be reduced.

In order to supply current to the drive motor, an existing 15-A intelligent power module (IPM) can be lowered to a 5-A IPM, thereby achieving a cost reduction effect.

When the gear reduction ratio of the planetary gear is set to 3.8:1 and the stacking height of the stator core is set to 14 mm, the maximum torque of the drive motor is 30.4 Nm. This does not satisfy 33.5 Nm, which is the minimum torque required for the washing machine having the inner diameter of 27 inches, thus deteriorating the washing performance.

Therefore, the adjustment of the torque constant is required for increasing the torque of the drive motor in the conditions in which the gear reduction ratio of the planetary gear and the size including the diameter of the drive motor and the slot fill are maintained and the stacking height of the stator core is set within the range of 13.5 mm to 14.5 mm (preferably 14 mm).

The slot fill means a ratio (%) of an area of a wound coil to an area of a winding space defined between adjacent poles. The winding space formed between the two adjacent poles is filled by coils wound around the two poles.

The coils wound around the two poles should not interfere with each other. In addition, in order for a coiling robot to wind the coils around the poles, a minimum space where the coiling robot can freely move into the coiling space must be secured. Therefore, the slot fill cannot be increased indefinitely, and the slot fill should not exceed a maximum of 42%, preferably 33%.

The torque value (Nm) of the drive motor is defined as the product of the torque constant (KT) and the supply current (I). The supply current is the current supplied to the drive motor through a component called an IPM and is defined as the sum of the torque current affecting the motor torque and the field weakening current affecting the motor speed.

In the case of the present disclosure, since the planetary gear module is applied, the torque of the drive motor can be lowered, thereby reducing the supply current. As a result, the capacity of the IPM can be reduced from 15-A IPM (meaning that the maximum current that can be supplied to the drive motor is 15 A) to 5-A IPM. However, for safety, the 5-A IPM has limited the rated capacity to supply 3 A.

Meanwhile, in order to increase the torque of the drive motor, as described above, it is necessary to increase the torque constant. To this end, it is necessary to increase the counter electromotive force of the drive motor. That is, when the counter electromotive force of the motor increases, the torque constant of the motor increases. As a result, the torque value of the motor increases.

As a method for increasing the counter electromotive force of the motor, the number of turns of the coil may be increased while reducing the wire diameter of the coil in the limited conditions as described above.

When the wire diameter of the coil is excessively reduced, the resistance value increases and the coil temperature increases. As a result, the efficiency of the motor is lowered and there is also a risk of fire. Thus, there is a limitation in reducing the wire diameter of the coil.

In addition, there is also a limitation in increasing the number of turns of the coil.

First, since the slot fill of the drive motor is fixed, there is a primary limitation that the number of turns of the coil cannot be increased indefinitely.

Second, the counter electromotive force increases as the number of turns of the coil increases. As a result, while the torque constant increases, the entry time of the field weakening control, which is controlled by supplying the field weakening current so as to increase the number of revolutions of the motor, becomes faster.

The field weakening control is a current control that supplies a current with a weak magnetic force so as to increase at a speed higher than the rotational speed of the motor in the washing mode. In the spin-drying mode, the field weakening control is performed so as to induce high speed rotation of the drive motor. The current supplied from the IPM to the drive motor is defined by the sum of the torque current of the motor and the field weakening current, and the supply current value is fixed.

In general, the drive motor rotates at about 500 rpm in the washing mode and rotates at 700 rpm or more in the spin-drying mode. The field weakening control starts when the rotational speed of the drive motor is approximately 600 rpm. However, when the counter electromotive force of the motor increases, the entry point of the field weakening control becomes faster. That is, the number of revolutions of the motor at which the field weakening control starts is lowered.

If the entry point of the field weakening control is lowered to the rotational speed in the washing mode, the field weakening control is also performed in the washing mode. Since the amount of current supplied from the IPM is fixed, the torque current value decreases in return when the field weakening current for field weakening control is supplied. As a result, the rotational speed of the motor increases while the torque value of the motor decreases.

When the torque value of the motor decreases in the washing mode, it means that the torque value of the pulsator decreases, which in turn causes a reduction in the washing performance. For this reason, it is necessary to delay the entry time of the field weakening control as much as possible, such that the field weakening control is performed only in the spin-drying mode. Therefore, it is said that there is a limitation in increasing the number of turns of the coil, and it is important to determine the optimal number of turns of the coil and the wire diameter by appropriately adjusting them.

Figure 14:
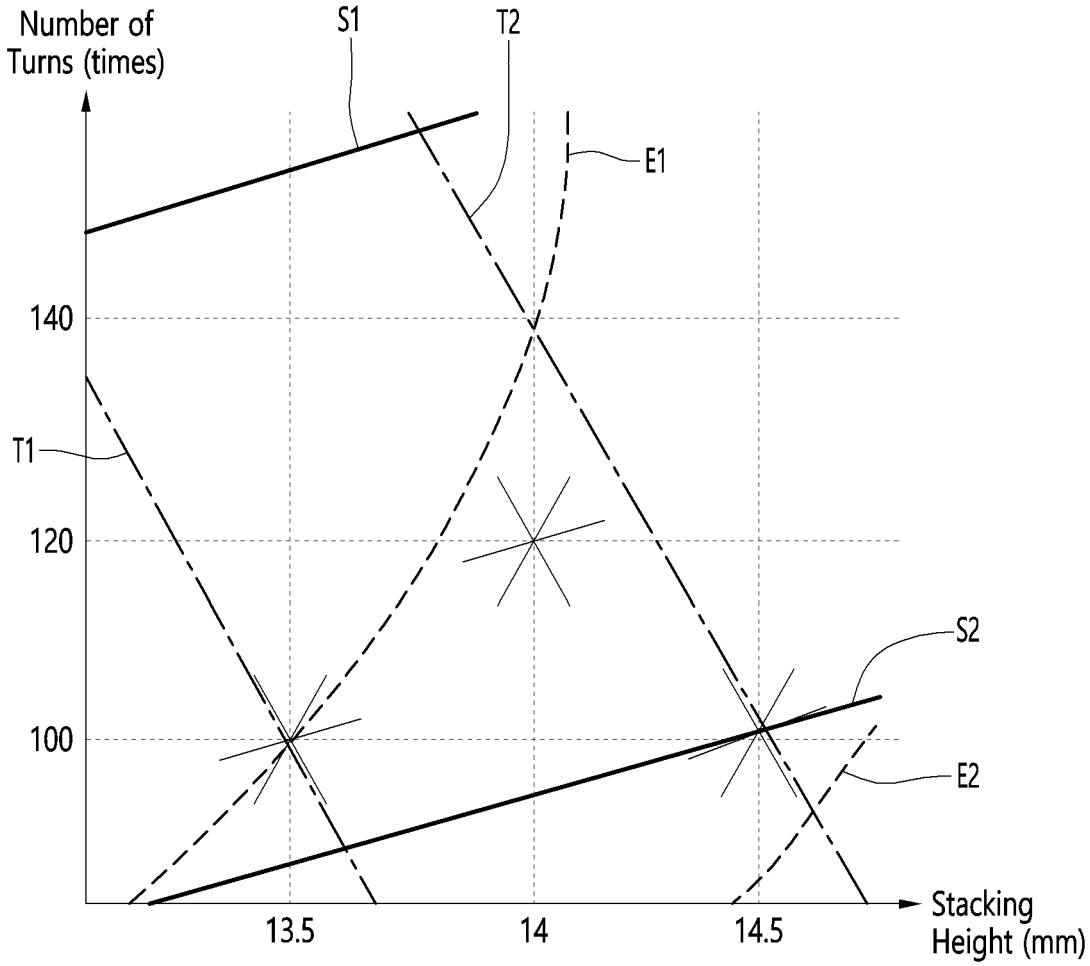
FIG. 14 is a so-called overlapping contour graph for extracting the appropriate number of turns of a coil with respect to a stacking height of a stator core, considering maximum torque, dynamic braking current, and motor efficiency.

FIG. 14 is a so-called overlapping contour graph for extracting the appropriate number of turns of the coil with respect to the stacking height of the stator core, considering maximum torque, dynamic braking current, and motor efficiency.

The overlapping contour graph of FIG. 14 shows changes in motor efficiency, dynamic braking current value, and maximum torque value in a state in which the stacking range of the stator core is limited to 13.5 mm to 14.5 mm.

In detail, in the graph, the x-axis is the stacking height of the stator core (mm) and the y-axis is the number of turns of the coil (number of times). Curves S1 and S2 represent the dynamic braking current value. The dynamic braking current value increases from S1 to S2.

The dynamic braking current refers to a current that flows back to the IPM as a reverse current generated when the motor stops. When the dynamic braking current value exceeds the rated supply current or the maximum supply current value of the IPM, the phenomenon that the IPM is burned out occurs. Therefore, it can be said that the motor is safer as the dynamic braking current value is lower.

In addition, the curves E1 and E2 represent the efficiency of the motor. The efficiency increases from E1 to E2.

In addition, the curves T1 and T2 represent the maximum torque of the motor. The maximum torque value increases from T1 to T2.

It is preferable that the point at which the stacking height of the stator meets the number of turns of the coil is in a region formed by the curves E1, T1, S2, and T2.

For example, when the point at which the stacking height of the stator core meets the number of turns of the coil goes to the left side of the curve E1, the efficiency of the motor decreases. When the point goes to the left side of the curve T1, the maximum torque value of the motor falls excessively.

In addition, even when the point goes to the right side of the curve T2, the maximum torque value of the motor is unnecessarily increased. When the point goes to the lower side of the curve S2, the dynamic braking current is excessively increased.

For this reason, it is preferable that the point at which the stacking height of the stator meets the number of turns of the coil is in the region formed by the curves E1, T1, S2, and T2.

When the stacking height of the stator core is 13.5 mm, the optimal number of turns of the coil is 100, and when the optimal number of turns of the coil exceeds 100, the efficiency of the motor is reduced.

When the stacking height of the stator core is 14.5 mm, the optimal number of turns of the coil is 100. When the optimal number of turns of the coil exceeds 100, the dynamic braking current is reduced and the torque is increased, but the efficiency of the motor is reduced.

When the stacking height of the stator core is 14 mm, it can be seen that the range of the change in the number of turns of the coil is the widest. Therefore, it is preferable to adjust the number of turns of the coil in a state in which the stacking height of the stator core is fixed to 14 mm.

In the condition in which the stacking height of the stator core is 14 mm, it is preferable that the minimum number of turns of the coil is 80 and the maximum number of turns is 140. When the minimum number of turns of the coil is less than 80, the efficiency of the motor increases, the sufficient counter electromotive force is not generated. Thus, the maximum torque value of the motor decreases and the dynamic braking current value increases. Above all, in order to generate the torque required by the 27-inch washing machine, it is preferable to set the minimum number of turns of the coil to 100 or more in the condition that the stacking height of the stator core is 14 mm.

In addition, when the stacking height of the stator core is 14 mm, the maximum number of turns of the coil is preferably 140 or less. The reason is that when the maximum number of turns of the coil exceeds 140, the maximum torque increases and the dynamic braking retention value decreases, but there is a limitation that the slot fill condition is not satisfied and the efficiency of the motor also decreases.

In addition, when the stacking height of the stator core is 14 mm, it is confirmed that the maximum number of turns of the coil is 120, considering the overlapping contour graph and the slot fill condition together.

When the number of turns of the coil is 120, the wire diameter of the coil is preferably 0.75φ, and the slot fill at this time is 33%.

When the number of turns of the coil is 140, the wire diameter of the coil is preferably 0.70φ, and the slot fill at this time is 42%.

When the number of turns of the coil is 100, the wire diameter of the coil is preferably 0.90φ, and the slot fill at this time is 39.6%. The reason why the slot fill when the number of turns of the coil is 120 is smaller than the slot fill when the number of turns of the coil is 100 is that the wire diameter is smaller.

According to an embodiment of the present disclosure, the maximum torque of the motor was measured to be about 37.62 Nm when the reduction ratio of the planetary gear was 3.8:1, the stacking height of the stator core was 14 mm, the number of turns of the coil was 120, and the wire diameter of the coil was 0.75φ. This was confirmed to exceed 33.5 Nm required by the 27-inch top loading type washing machine.

As described above, it was confirmed that the maximum torque of the motor could be increased, without changing the size of the motor, by appropriately adjusting the number of turns and the wire diameter of the coil.

The invention claimed is:

1. A washing machine comprising:

a cabinet having an opened upper surface and forming an outer appearance;

a top cover covering the opened upper surface of the cabinet and having a laundry inlet formed therein;

a door coupled to the top cover to open or close the laundry inlet;

a base coupled to a lower end of the cabinet to support the cabinet;

an outer tub accommodated in the cabinet and filled with wash water;

an inner tub which is accommodated in the outer tub and into which laundry is put;

a pulsator mounted on a bottom of the inner tub to allow the wash water and the laundry to forcibly flow; and a driver mounted on a bottom of the outer tub to provide rotational force to the pulsator and the inner tub, wherein the driver comprises:

a drive motor including:

a stator fixed to the bottom of the outer tub; and a rotor rotating at an outside of the stator;

a shaft portion including:

a washing shaft that transmits rotational force of the drive motor to the pulsator; and a spin-drying shaft that transmits the rotational force of the drive motor to the inner tub; and a planetary gear disposed at any point of the shaft portion to reduce a rotational speed of the washing shaft and increase torque, wherein the stator comprises:

a stator core formed of a plurality of iron plates that are stacked, the plurality of iron plates each including a yoke and a plurality of poles extending radially from an outer edge of the yoke and spaced apart in a circumferential direction;

an insulator covering the stator core; and a coil wound around an outer circumferential surface of the pole covered by the insulator, wherein a rotation speed ratio of the drive motor to the pulsator by the planetary gear is 3.8:1, a stacking height of the stator core is 13.5 mm to 14.5 mm, and the number of turns of the coil is 100 to 140.

2. The washing machine according to claim 1, wherein the stacking height of the stator core is 14 mm.

3. The washing machine according to claim 2, wherein, when the number of turns of the coil is 100, a wire diameter of the coil is 0.90φ and a slot fill is 39.6%.

4. The washing machine according to claim 2, wherein, when the number of turns of the coil is 120, a wire diameter of the coil is 0.75φ and a slot fill is 33.0%.

5. The washing machine according to claim 2, wherein, when the number of turns of the coil is 140, a wire diameter of the coil is 0.70φ and a slot fill is 42.0%.

6. The washing machine according to claim 1, wherein a slot fill of the stator core is 33% to 42%.

7. The washing machine according to claim 1, wherein, as the number of turns of the coil increases, a wire diameter of the coil decreases.

8. The washing machine according to claim 1, wherein an intelligent power module (IPM) configured to supply current to the drive motor has a maximum supply current value of 5 A.

9. The washing machine according to claim 1, wherein a rated supply current value of an IPM configured to supply current to the drive motor is limited to 3 A.

* * * * *